US007838187B2

(12) United States Patent
Lin et al.

(10) Patent No.: US 7,838,187 B2
(45) Date of Patent: Nov. 23, 2010

(54) IMAGING MEMBER

(75) Inventors: Liang-Bih Lin, Rochester, NY (US); Daniel V. Levy, Rochester, NY (US); Jin Wu, Webster, NY (US); Robert W. Hedrick, Spencerport, NY (US); Gary A. Batt, Fairport, NY (US); M. John Hinckel, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 759 days.

(21) Appl. No.: 11/894,451

(22) Filed: Aug. 21, 2007

(65) Prior Publication Data

US 2009/0053635 A1 Feb. 26, 2009

(51) Int. Cl.
*G03G 15/02* (2006.01)

(52) U.S. Cl. ..... 430/58.2; 430/58.35

(58) Field of Classification Search ..... 430/58.2, 430/58.35

See application file for complete search history.

(56) References Cited

U.S. PATENT DOCUMENTS

| | | | | |
|---|---|---|---|---|
| 3,121,006 | A | 2/1964 | Middleton et al. | |
| 4,265,990 | A | 5/1981 | Stolka et al. | |
| 4,286,033 | A | 8/1981 | Neyhart et al. | |
| 4,291,110 | A | 9/1981 | Lee | |
| 4,338,387 | A | 7/1982 | Hewitt | |
| 4,587,189 | A | 5/1986 | Hor et al. | |
| 4,664,995 | A | 5/1987 | Horgan et al. | |
| 4,988,597 | A | 1/1991 | Spiewak et al. | |
| 5,244,762 | A | 9/1993 | Spiewak et al. | |
| 5,756,245 | A | 5/1998 | Esteghamatian et al. | |
| 6,991,880 | B2 * | 1/2006 | Tong et al. | 430/58.15 |
| 7,312,008 | B2 * | 12/2007 | Wu et al. | 430/66 |
| 7,468,231 | B2 * | 12/2008 | Lin et al. | 430/75 |
| 7,585,602 | B2 * | 9/2009 | Wu et al. | 430/56 |
| 7,700,248 | B2 * | 4/2010 | Jin et al. | 430/58.2 |
| 2009/0253056 | A1 * | 10/2009 | Yu | 430/58.05 |

* cited by examiner

*Primary Examiner*—Mark F Huff
*Assistant Examiner*—Roland Martin, Jr.
(74) *Attorney, Agent, or Firm*—Pillsbury Winthrop Shaw Pittman LLP

(57) ABSTRACT

The presently disclosed embodiments are directed to charge transport layers useful in electrostatography. More particularly, the embodiments pertain to an improved electrostatographic imaging member having a charge transport layer that is dual-dopant, wherein operating life improvement is achieved by incorporating a small amount of compatible thermalsetting resin and polyhedral oligomeric silsesquioxane into the layer. Incorporation of these resins have been shown to increase charge transport life.

24 Claims, 4 Drawing Sheets

IMAGING MEMBER

CROSS REFERENCE TO RELATED APPLICATIONS

Reference is made to copending, commonly assigned U.S. patent application to Lin et al., filed Aug. 21, 2007, entitled, "Improved Imaging Member" Ser. No. 11/894,422, and copending, commonly assigned U.S. patent application to Lin et al., filed Aug. 21, 2007, entitled, "Improving Imaging Member" Ser. No. 11/894,421, the subject matter of which are incorporated by reference herein in their entirely.

BACKGROUND

The presently disclosed embodiments relate generally to layers that are useful in imaging apparatus members and components, for use in electrostatographic, including digital, apparatuses. More particularly, the embodiments pertain to an improved electrostatographic imaging member having a charge transport layer that is comprised of at least two dopants, and wherein one of the dopants is a compatible thermalsetting resin and the other is a polyhedral oligomeric silsesquioxane (POSS). Incorporation of these resins has been shown to improved wear and increase life span.

Electrophotographic imaging members, e.g., photoreceptors, photoconductors, imaging members, and like, typically include a photoconductive layer formed on an electrically conductive substrate. The photoconductive layer is an insulator in the substantial absence of light so that electric charges are retained on its surface. Upon exposure to light, charge is generated by the photoactive pigment, and under applied field charge moves through the photoreceptor and the charge is dissipated.

In electrophotography, also known as xerography, electrophotographic imaging or electrostatographic imaging, the surface of an electrophotographic plate, drum, belt or the like (imaging member or photoreceptor) containing a photoconductive insulating layer on a conductive layer is first uniformly electrostatically charged. The imaging member is then exposed to a pattern of activating electromagnetic radiation, such as light. Charge generated by the photoactive pigment move under the force of the applied field. The movement of the charge through the photoreceptor selectively dissipates the charge on the illuminated areas of the photoconductive insulating layer while leaving behind an electrostatic latent image. This electrostatic latent image may then be developed to form a visible image by depositing oppositely charged particles on the surface of the photoconductive insulating layer. The resulting visible image may then be transferred from the imaging member directly or indirectly (such as by a transfer or other member) to a print substrate, such as transparency or paper. The imaging process may be repeated many times with reusable imaging members.

An electrophotographic imaging member may be provided in a number of forms. For example, the imaging member may be a homogeneous layer of a single material such as vitreous selenium or it may be a composite layer containing a photoconductor and another material. In addition, the imaging member may be layered. These layers can be in any order, and sometimes can be combined in a single or mixed layer.

Typical multilayered photoreceptors or imaging members have at least two layers, and may include a substrate, a conductive layer, an optional charge blocking layer, an optional adhesive layer, a photogenerating layer (sometimes referred to as a "charge generation layer," "charge generating layer," or "charge generator layer"), a charge transport layer, an optional overcoating layer and, in some belt embodiments, an anticurl backing layer. In the multilayer configuration, the active layers of the photoreceptor are the charge generation layer (CGL) and the charge transport layer (CTL). Enhancement of charge transport across these layers provides better photoreceptor performance. In some embodiments, the CGL and CTL may be formed in a single imaging layer. In other embodiments, the CTL may have multiple layers, for example, dual layers having a top layer and a bottom layer.

The term "photoreceptor" is generally used interchangeably with the terms "imaging member" and "photoconductor." The term "electrostatographic" includes "electrophotographic" and "xerographic." The terms "charge transport molecule" are generally used interchangeably with the terms "hole transport molecule."

One type of composite photoconductive layer used in xerography is illustrated in U.S. Pat. No. 4,265,990 which describes a photosensitive member having at least two electrically operative layers. One layer comprises a photoconductive layer which is capable of photogenerating holes and injecting the photogenerated holes into a contiguous charge transport layer (CTL). Generally, where the two electrically operative layers are supported on a conductive layer, the photoconductive layer is sandwiched between a contiguous CTL and the supporting conductive layer. Alternatively, the CTL may be sandwiched between the supporting electrode and a photoconductive layer. Photosensitive members having at least two electrically operative layers, as disclosed above, provide excellent electrostatic latent images when charged in the dark with a uniform negative electrostatic charge, exposed to a light image and thereafter developed with finely divided electroscopic marking particles. The resulting toner image is usually transferred to a suitable receiving member such as paper or to an intermediate transfer member, which thereafter transfers the image to a member such as paper.

In the case where the charge-generating layer (CGL) is sandwiched between the CTL and the electrically conducting layer, the outer surface of the CTL is charged negatively and the conductive layer is charged positively. The CGL then should be capable of generating electron hole pair when exposed image wise and inject only the holes through the CTL. In the alternate case when the CTL is sandwiched between the CGL and the conductive layer, the outer surface of CGL layer is charged positively while conductive layer is charged negatively and the holes are injected through from the CGL to the CTL. The CTL should be able to transport the holes with as little trapping of charge as possible. In flexible web like photoreceptor the charge conductive layer may be a thin coating of metal on a thin layer of thermoplastic resin.

In a typical machine design, a flexible imaging member belt is mounted over and around a belt support module comprising numbers of belt support rollers, such that the top outermost charge transport layer is exposed to all electrophotographic imaging subsystems interactions. Under a normal machine imaging function condition, the top exposed charge transport layer surface of the flexible imaging member belt is constantly subjected to physical/mechanical/electrical/chemical species actions against the mechanical sliding actions of cleaning blade and cleaning brush, electrical charging devices, corona effluents exposure, developer components, image formation toner particles, hard carrier particles, receiving paper, and the like during dynamic belt cyclic motion. These machine subsystems interaction against the surface of the charge transport layer has been found to consequently cause surface contamination, scratching, abrasion and rapid charge transport layer surface wear problems.

As electrophotography advances, the complex, highly sophisticated duplicating systems need to operate at very high speeds, which places stringent requirements on imaging members and may reduce imaging member longevity. For example, the stringent conditions lead to abrasion of the charge transport layer and the wear of the surface generates powder, which can deposit in the machine and cause problems for other components, for example, dirty the optical elements, and spoil the charge uniformity. Excessive charge transport wear is a serious problem because it causes significant change in the charged field potential to adversely impact copy printout quality. Thus, there is a continued need for achieving desired mechanical properties such as abrasion resistance, crack resistance, wear resistance and low surface energy to help increase imaging member life span.

SUMMARY

According to aspects illustrated herein, there is provided a charge transport layer that addresses the shortcomings of traditional imaging members discussed above. These compositions and processes are related to a mechanically robust charge transport layer, which enhances abrasion, scratch, and wear resistance and thus increase life of the imaging member under normal machine functions.

An embodiment may include an imaging member comprising a substrate, an undercoat layer disposed on the substrate, a charge generation layer disposed on the undercoat layer, a dual-dopant charge transport layer disposed on the charge generation layer, the dual-dopant charge transport layer further comprising a polymeric binder and a combination of a melamine resin and a polyhedral oligomeric silsesquioxane (POSS), and an optional overcoat layer disposed on the charge transport layer.

A further embodiment may include an imaging member comprising a substrate, an undercoat layer disposed on the substrate, a charge generation layer disposed on the undercoat layer, a dual-dopant charge transport layer disposed on the charge generation layer, the dual-dopant charge transport layer further comprising a polycarbonate Z polymer and a combination of a melamine resin and a polyhedral oligomeric silsesquioxane, wherein the polyhedral oligomeric silsesquioxane is represented by the general molecular formula:

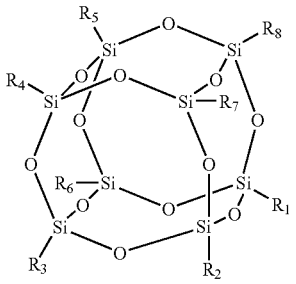

wherein each R is independently selected from the group consisting of at least one of hydrogen and from about 1 to about 40 carbon atoms, and an optional overcoat layer disposed on the charge transport layer.

In still another embodiment, there is provided an image forming apparatus for forming images on a recording medium comprising an imaging member having a charge retentive-surface to receive an electrostatic latent image thereon, wherein the imaging member comprises a substrate, an undercoat layer disposed on the substrate, a charge generation layer disposed on the undercoat layer, a dual-dopant charge transport layer disposed on the charge generation layer, the dual-dopant charge transport layer further comprising a polymeric binder and a combination of a melamine resin and a polyhedral oligomeric silsesquioxane, wherein the polyhedral oligomeric silsesquioxane is represented by the general molecular formula:

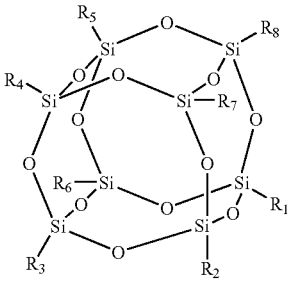

wherein each R is independently selected from the group consisting of at least one of hydrogen and from about 1 to about 40 carbon atoms, and an optional overcoat layer disposed on the charge transport layer, b) a development member for applying a developer material to the charge-retentive surface to develop the electrostatic latent image to form a developed image on the charge-retentive surface, c) a transfer member for transferring the developed image from the charge-retentive surface to an intermediate transfer member or a copy substrate, and d) a fusing member for fusing the developed image to the copy substrate.

BRIEF DESCRIPTION OF THE DRAWINGS

For a better understanding, reference may be had to the accompanying figures.

DETAILED DESCRIPTION

Figure 1:
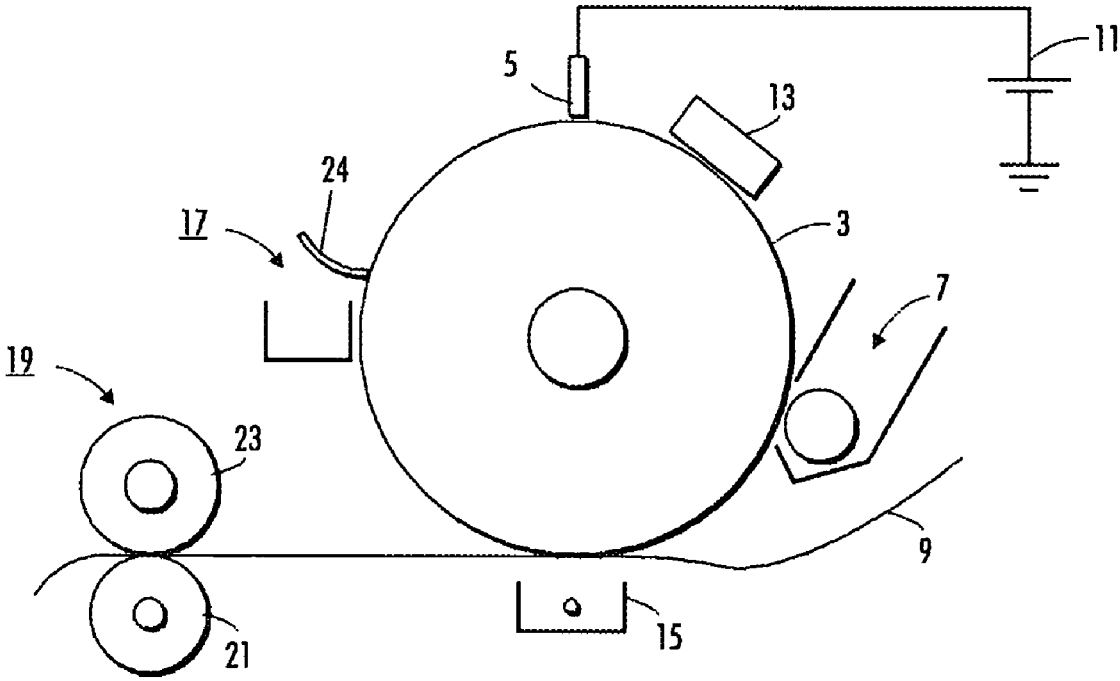
FIG. 1 is a schematic nonstructural view showing an image forming apparatus according to the present embodiments.

In the following description, reference is made to the accompanying drawings, which form a part hereof and which illustrate several embodiments. It is understood that other embodiments may be utilized and structural and operational changes may be made without departure from the scope of the present disclosure.

The presently disclosed embodiments are directed generally to layers useful in imaging apparatus components, such as an imaging member, possessing improved mechanical properties. More particularly, the embodiments pertain to an improved electrostatographic imaging member having a charge transport layer that is comprised of a thermalsetting resin and a polyhedral oligomeric silsesquioxane. Incorporation of these resins have been shown to impart wear and abrasion resistance, and thus, increase charge transport life.

Life extension of imaging members is one of the most challenging technical issues in the photoreceptor arts, especially life limiting factors associated with degradation of the top layer. It is known to use polytetrafluoroethylene (PTFE)-doped charge transport layer in several drum-based products, but the average improvement in print life is only about 10-30% over that of convention devices. Consequently, cartridge life is not acceptable and more importantly, total cost of ownership (TCO) is decreased. However, the additional layer introduces more complications to the already sophisticated layered technology and a number of related product defects such as charge deficient spots (CDS), ghosting, are very difficult to solve.

By having a dual-dopant charge transport layer, wear and abrasion resistance are increased. In addition, bias charging roller (BCR) wear rates are improved. These crosslinkable resins provide increased results without deteriorating other functional performances. In addition, by further incorporating PTFE particles as lubricant in the charge transport layer, the improved lubrication and toner cleaning and transfer provides further life extension. Inclusion of PTFE also exhibits noise reduction.

In a typical electrostatographic reproducing apparatus such as electrophotographic imaging system using a photoreceptor, a light image of an original to be copied is recorded in the form of an electrostatic latent image upon a photosensitive member and the latent image is subsequently rendered visible by the application of a developer mixture. The developer, having toner particles contained therein, is brought into contact with the electrostatic latent image to develop the image on an electrostatographic imaging member which has a charge-retentive surface. The developed toner image can then be transferred to a copy substrate, such as paper, that receives the image via a transfer member.

The exemplary embodiments of this disclosure are described below with reference to the drawings. The specific terms are used in the following description for clarity, selected for illustration in the drawings and not to define or limit the scope of the disclosure. The same reference numerals are used to identify the same structure in different Figures unless specified otherwise. The structures in the figures are not drawn according to their relative proportions and the drawings should not be interpreted as limiting the disclosure in size, relative size, or location. In addition, though the discussion will address negatively charged systems, the imaging members of the present disclosure may also be used in positively charged systems.

Referring to FIG. 1, in a typical electrostatographic reproducing apparatus, a light image of an original to be copied is recorded in the form of an electrostatic latent image upon a photosensitive member and the latent image is subsequently rendered visible by the application of electroscopic thermoplastic resin particles which are commonly referred to as toner. Specifically, photoreceptor 3 is charged on its surface by means of an electrical charger 5 to which a voltage has been supplied from power supply 11. The photoreceptor is then imagewise exposed to light from an optical system or an image input apparatus 13, such as a laser and light emitting diode, to form an electrostatic latent image thereon. Generally, the electrostatic latent image is developed by bringing a developer mixture from developer station 7 into contact therewith. Development can be effected by use of a magnetic brush, powder cloud, or other known development process.

After the toner particles have been deposited on the photoconductive surface, in image configuration, they are transferred to a copy sheet 9 by transfer means 15, which can be pressure transfer or electrostatic transfer. In embodiments, the developed image can be transferred to an intermediate transfer member and subsequently transferred to a copy sheet.

After the transfer of the developed image is completed, copy sheet 9 advances to fusing station 19, depicted in FIG. 1 as fusing and pressure rolls, wherein the developed image is fused to copy sheet 9 by passing copy sheet 9 between the fusing member 23 and pressure member 21, thereby forming a permanent image. Fusing may be accomplished by other fusing members such as a fusing belt in pressure contact with a pressure roller, fusing roller in contact with a pressure belt, or other like systems. Photoreceptor 3, subsequent to transfer, advances to cleaning station 17, wherein any toner left on photoreceptor 3 is cleaned therefrom by use of a blade 24 (as shown in FIG. 1), brush, or other cleaning apparatus.

Figure 2:
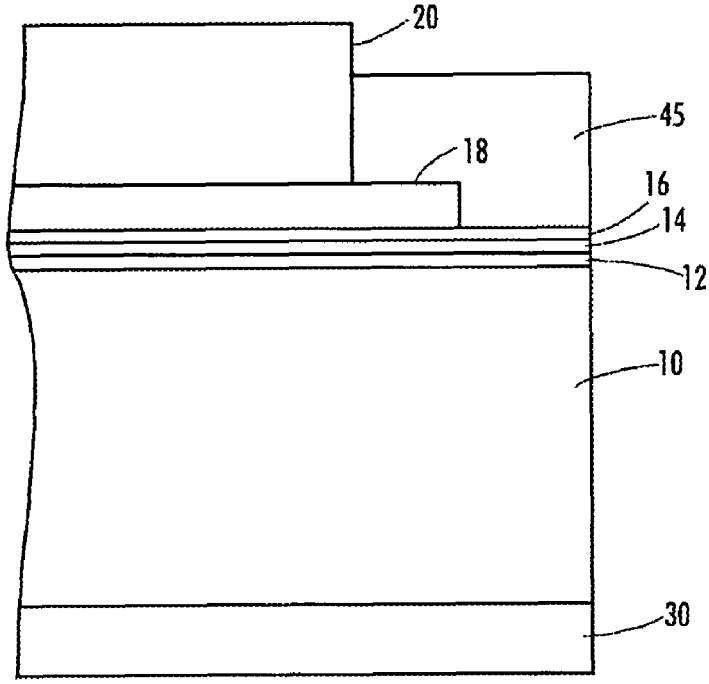
FIG. 2 is a cross-sectional view of a multilayered electrophotographic imaging member according to the present embodiments.

Electrophotographic imaging members are well known in the art. Electrophotographic imaging members may be prepared by any suitable technique. An exemplary embodiment of a multilayered electrophotographic imaging member of flexible belt configuration is illustrated in FIG. 2. The exemplary imaging member includes a support substrate 10 having an optional conductive surface layer or layers 12 (which may be referred to herein as a ground plane layer), optional if the substrate itself is conductive, a hole blocking layer 14, an optional adhesive interface layer 16, a charge generating layer 18 and a charge transport layer 20. The charge generating layer 18 and the charge transport layer 20 forms an imaging layer described here as two separate layers. It will be appreciated that the functional components of these layers may alternatively be combined into a single layer.

Other layers of the imaging member may include, for example, an optional ground strip layer 45, applied to one edge of the imaging member to promote electrical continuity with the conductive layer 12 through the hole blocking layer 14. An anti-curl backing layer 30 of the photoreceptor may be formed on the backside of the support substrate 10. The conductive ground plane 12 is typically a thin metallic layer, for example a 10 nanometer thick titanium coating, deposited over the substrate 10 by vacuum deposition or sputtering process. The layers 14, 16, 18, and 20 may be separately and sequentially deposited on to the surface of conductive ground plane 12 of substrate 10 as solutions comprising a solvent, with each layer being dried before deposition of the next. The ground strip layer 45 may be applied after coating these layers or simultaneously with the CTL. As an alternative to separate charge transport 20 and charge generation layers 18, the two layers can be combined into a single imaging layer and employed with other layers of the photoreceptor being formed as described below.

Figure 3:
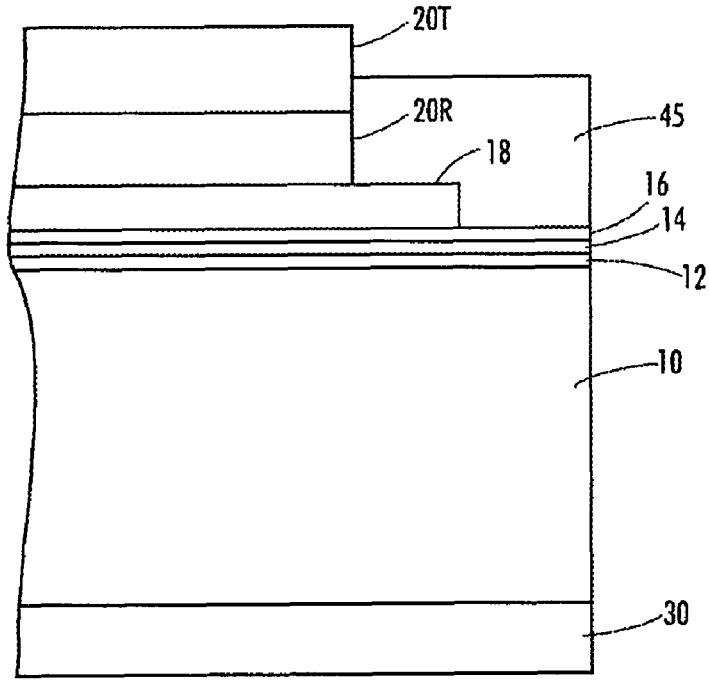
FIG. 3 is a cross-sectional view of a multilayered electrophotographic imaging member according to another embodiment.

In the exemplary embodiment of FIG. 3, the CTL comprises a dual charge transport layer 20L and 20T, a first lower or bottom charge transport layer 20L being in contact with the charge generator layer 18, with the top layer 20T being the outermost layer. The dual transport layer 20L and 20T may have same or different composition and thickness.

The Substrate

The photoreceptor support substrate 10 may be opaque or substantially transparent, and may comprise any suitable organic or inorganic material having the requisite mechanical properties. The entire substrate can comprise the same material as that in the electrically conductive surface, or the electrically conductive surface can be merely a coating on the substrate. Any suitable electrically conductive material can be employed. Typical electrically conductive materials include copper, brass, nickel, zinc, chromium, stainless steel, conductive plastics and rubbers, aluminum, semitransparent aluminum, steel, cadmium, silver, gold, zirconium, niobium, tantalum, vanadium, hafnium, titanium, nickel, chromium, tungsten, molybdenum, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. It could be single metallic compound or dual layers of different metals and/or oxides.

The substrate 10 can also be formulated entirely of an electrically conductive material, or it can be an insulating material including inorganic or organic polymeric materials, such as MYLAR, a commercially available biaxially oriented polyethylene terephthalate from DuPont, or polyethylene naphthalate available as KALEDEX 2000, with a ground plane layer 12 comprising a conductive titanium or titanium/zirconium coating, otherwise a layer of an organic or inorganic material having a semiconductive surface layer, such as indium tin oxide, aluminum, titanium, and the like, or exclusively be made up of a conductive material such as, aluminum, chromium, nickel, brass, other metals and the like. The thickness of the support substrate depends on numerous factors, including mechanical performance and economic considerations.

The substrate 10 may have a number of many different configurations, such as for example, a plate, a cylinder, a drum, a scroll, an endless flexible belt, and the like. In the case of the substrate being in the form of a belt, the belt can be seamed or seamless.

The thickness of the substrate 10 depends on numerous factors, including flexibility, mechanical performance, and economic considerations. The thickness of the support substrate 10 may range from about 25 micrometers to about 3,000 micrometers. In embodiments of flexible photoreceptor belt preparation, the thickness of substrate 10 is from about 50 micrometers to about 200 micrometers for optimum flexibility and to effect minimum induced photoreceptor surface bending stress when a photoreceptor belt is cycled around small diameter rollers in a machine belt support module, for example, 19 millimeter diameter rollers.

An exemplary substrate support 10 is not soluble in any of the solvents used in each coating layer solution, is optically transparent or semi-transparent, and is thermally stable up to a high temperature of about 150° C. A typical substrate support 10 used for imaging member fabrication has a thermal contraction coefficient-ranging from about $1\times10^{-5}$ per ° C. to about $3\times10^{-5}$ per ° C. and a Young's Modulus of between about $5\times10^{-5}$ psi ($3.5\times10^{-4}$ Kg/cm2) and about $7\times10^{-5}$ psi ($4.9\times10^{-4}$ Kg/cm2).

The Conductive Layer

The conductive ground plane layer 12 may vary in thickness depending on the optical transparency and flexibility desired for the electrophotographic imaging member. When a photoreceptor flexible belt is desired, the thickness of the conductive layer 12 on the support substrate 10, for example, a titanium and/or zirconium conductive layer produced by a sputtered deposition process, typically ranges from about 2 nanometers to about 75 nanometers to allow adequate light transmission for proper back erase, and in embodiments from about 10 nanometers to about 20 nanometers for an optimum combination of electrical conductivity, flexibility, and light transmission. Generally, for rear erase exposure, a conductive layer light transparency of at least about 15 percent is desirable. The conductive layer need not be limited to metals. The conductive layer 12 may be an electrically conductive metal layer which may be formed, for example, on the substrate by any suitable coating technique, such as a vacuum depositing or sputtering technique. Typical metals suitable for use as conductive layer 12 include aluminum, zirconium, niobium, tantalum, vanadium, hafnium, titanium, nickel, stainless steel, chromium, tungsten, molybdenum, combinations thereof, and the like. Where the entire substrate is an electrically conductive metal, the outer surface can perform the function of an electrically conductive layer and a separate electrical conductive layer may be omitted. Other examples of conductive layers may be combinations of materials such as conductive indium tin oxide as a transparent layer for light having a wavelength between about 4000 Angstroms and about 9000 Angstroms or a conductive carbon black dispersed in a plastic binder as an opaque conductive layer.

The illustrated embodiment will be described in terms of a substrate layer 10 comprising an insulating material including inorganic or organic polymeric materials, such as, MYLAR with a ground plane layer 12 comprising an electrically conductive material, such as titanium or titanium/zirconium, coating over the substrate layer 10.

The Hole Blocking Layer

An optional hole blocking layer 14 may then be applied to the substrate 10 or to the layer 12, where present. Any suitable positive charge (hole) blocking layer capable of forming an effective barrier to the injection of holes from the adjacent conductive layer 12 into the photoconductive or charge generating layer may be utilized. The charge (hole) blocking layer may include polymers, such as, polyvinylbutyral, epoxy resins, polyesters, polysiloxanes, polyamides, polyurethanes, HEMA, hydroxylpropyl cellulose, polyphosphazine, and the like, or may comprise nitrogen containing siloxanes or silanes, or nitrogen containing titanium or zirconium compounds, such as, titanate and zirconate. The hole blocking layer should be continuous and may have a thickness in a wide range of from about 0.2 microns to about 10 micrometers depending on the type of material chosen for use in a photoreceptor design. Typical hole blocking layer materials include, for example, trimethoxysilyl propylene diamine, hydrolyzed trimethoxysilyl propyl ethylene diamine, N-beta-(aminoethyl)gamma-aminopropyl trimethoxy silane, isopropyl 4-aminobenzene sulfonyl di(dodecylbenzene sulfonyl) titanate, isopropyl di(4-aminobenzoyl)isostearoyl titanate, isopropyl tri(N-ethylaminoethylamino)titanate, isopropyl trianthranil titanate, isopropyl tri(N,N-dimethylethylamino)titanate, titanium-4-amino benzene sulfonate oxyacetate, titanium 4-aminobenzoate isostearate oxyacetate, (gamma-aminobutyl)methyl diethoxysilane which has the formula

[H2N(CH2)4]CH3Si(OCH3)2, and (gamma-aminopropyl) methyl diethoxysilane, which has the formula [H2N(CH2)3] CH33Si(OCH3)2, and combinations thereof, as disclosed, for example, in U.S. Pat. Nos. 4,338,387; 4,286,033; and 4,291,110, incorporated herein by reference in their entireties. An embodiment of a hole blocking layer comprises a reaction product between a hydrolyzed silane or mixture of hydrolyzed silanes and the oxidized surface of a metal ground plane layer. The oxidized surface inherently forms on the outer surface of most metal ground plane layers when exposed to air after deposition. This combination enhances electrical stability at low RH. Other suitable charge blocking layer polymer compositions are also described in U.S. Pat. No. 5,244,762 which is incorporated herein by reference in its entirety. These include vinyl hydroxyl ester and vinyl hydroxy amide polymers wherein the hydroxyl groups have been partially modified to benzoate and acetate esters which are then blended with other unmodified vinyl hydroxy ester and amide unmodified polymers. An example of such a blend is a 30 mole percent benzoate ester of poly(2-hydroxyethyl methacrylate) blended with the parent polymer poly(2-hydroxyethyl methacrylate). Still other suitable charge blocking layer polymer compositions are described in U.S. Pat. No. 4,988,597, which is incorporated herein by reference in its entirety. These include polymers containing an alkyl acrylamidoglycolate alkyl ether repeat unit. An example of such an alkyl acrylamidoglycolate alkyl ether containing polymer is the copolymer poly(methyl acrylamidoglycolate methyl ether-co-2-hydroxyethyl methacrylate).

The blocking layer 14 can be continuous or substantially continuous and may have a thickness of less than about 10 micrometers because greater thicknesses may lead to undesirably high residual voltage. In aspects of the exemplary embodiment, a blocking layer of from about 0.005 micrometers to about 2 micrometers gives optimum electrical performance. The blocking layer may be applied by any suitable conventional technique, such as, spraying, dip coating, draw bar coating, gravure coating, silk screening, air knife coating, reverse roll coating, vacuum deposition, chemical treatment, and the like. For convenience in obtaining thin layers, the blocking layer may be applied in the form of a dilute solution, with the solvent being removed after deposition of the coating by conventional techniques, such as, by vacuum, heating, and the like. Generally, a weight ratio of blocking layer material and solvent of between about 0.05:100 to about 5:100 is satisfactory for spray coating.

The Adhesive Interface Layer

An optional separate adhesive interface layer 16 may be provided. In the embodiment illustrated in FIG. 1, an interface layer 16 is situated intermediate the blocking layer 14 and the charge generator layer 18. The interface layer may include a copolyester resin. Exemplary polyester resins which may be utilized for the interface layer include polyarylatepolyvinylbutyrals, such as ARDEL POLYARYLATE (U-100) commercially available from Toyota Hsutsu Inc., VITEL PE-100, VITEL PE-200, VITEL PE-200D, and VITEL PE-222, all from Bostik, 49,000 polyester from Rohm Hass, polyvinyl butyral, and the like. The adhesive interface layer 16 may be applied directly to the hole blocking layer 14. Thus, the adhesive interface layer 16 in embodiments is in direct contiguous contact with both the underlying hole blocking layer 14 and the overlying charge generator layer 18 to enhance adhesion bonding to provide linkage. In yet other embodiments, the adhesive interface layer 16 is entirely omitted.

Any suitable solvent or solvent mixtures may be employed to form a coating solution of the polyester for the adhesive interface layer 16. Typical solvents include tetrahydrofuran, toluene, monochlorbenzene, methylene chloride, cyclohexanone, and the like, and mixtures thereof. Any other suitable and conventional technique may be used to mix and thereafter apply the adhesive layer coating mixture to the hole blocking layer. Typical application techniques include spraying, dip coating, roll coating, wire wound rod coating, and the like. Drying of the deposited wet coating may be effected by any suitable conventional process, such as oven drying, infra red radiation drying, air drying, and the like.

The adhesive interface layer 16 may have a thickness of from about 0.01 micrometers to about 900 micrometers after drying. In embodiments, the dried thickness is from about 0.03 micrometers to about 1 micrometer.

The Charge Generating Layer

The charge generating layer 18 may thereafter be applied to the adhesive layer 16. Any suitable charge generating binder including a charge generating/photoconductive material, which may be in the form of particles and dispersed in a film forming binder, such as an inactive resin, may be utilized. Examples of charge generating materials include, for example, inorganic photoconductive materials such as amorphous selenium, trigonal selenium, and selenium alloys selected from the group consisting of selenium-tellurium, selenium-tellurium-arsenic, selenium arsenide and mixtures thereof, and organic photoconductive materials including various phthalocyanine pigments such as the X-form of metal free phthalocyanine, metal phthalocyanines such as vanadyl phthalocyanine and copper phthalocyanine, hydroxy gallium phthalocyanines, chlorogallium phthalocyanines, titanyl phthalocyanines, quinacridones, dibromo anthanthrone pigments, benzimidazole perylene, substituted 2,4-diamino-triazines, polynuclear aromatic quinones, and the like dispersed in a film forming polymeric binder. Selenium, selenium alloy, benzimidazole perylene, and the like and mixtures thereof may be formed as a continuous, homogeneous charge generating layer. Benzimidazole perylene compositions are well known and described, for example, in U.S. Pat. No. 4,587,189, the entire disclosure thereof being incorporated herein by reference. Multi-charge generating layer compositions may be utilized where a photoconductive layer enhances or reduces the properties of the charge generating layer. Other suitable charge generating materials known in the art may also be utilized, if desired. The charge generating materials selected should be sensitive to activating radiation having a wavelength between about 400 and about 900 nm during the imagewise radiation exposure step in an electrophotographic imaging process to form an electrostatic latent image. For example, hydroxygallium phthalocyanine absorbs light of a wavelength of from about 370 to about 950 nanometers, as disclosed, for example, in U.S. Pat. No. 5,756,245.

Any suitable inactive resin materials may be employed as a binder in the charge generating layer 18, including those described, for example, in U.S. Pat. No. 3,121,006, the entire disclosure thereof being incorporated herein by reference. Typical organic resinous binders include thermoplastic and thermalsetting resins such as one or more of polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl butyral, polyvinyl acetate, polysiloxanes, polyacrylates, polyvinyl acetals, polyamides, polyimides, amino resins, phenylene oxide resins, terephthalic acid resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride/vinylchloride copolymers, vinylacetate/vinylidene chloride copolymers, styrene-alkyd resins, and the like. Another film-forming polymer binder is PCZ-400 (poly (4,4'-dihydroxy-diphenyl-1-1-cyclohexane) which has a viscosity-molecular weight of 40,000 and is available from Mitsubishi Gas Chemical Corporation.

The charge generating material can be present in the resinous binder composition in various amounts. Generally, from about 5 percent by volume to about 90 percent by volume of the charge generating material is dispersed in about 10 percent by volume to about 95 percent by volume of the resinous binder, and more specifically from about 20 percent by volume to about 60 percent by volume of the charge generating material is dispersed in about 40 percent by volume to about 80 percent by volume of the resinous binder composition.

The charge generating layer 18 containing the charge generating material and the resinous binder material generally ranges in thickness of from about 0.1 micrometer to about 5 micrometers, for example, from about 0.3 micrometers to about 3 micrometers when dry. The charge generating layer thickness is generally related to binder content. Higher binder content compositions generally employ thicker layers for charge generation.

The Charge Transport Layer

The charge transport layer 20 is thereafter applied over the charge generating layer 18 and may include any suitable transparent organic polymer or non-polymeric material capable of supporting the injection of photogenerated holes or electrons from the charge generating layer 18 and capable of allowing the transport of these holes/electrons through the charge transport layer to selectively discharge the surface charge on the imaging member surface. In one embodiment, the charge transport layer 20 not only serves to transport holes, but also protects the charge generating layer 18 from abrasion or chemical attack and may therefore extend the service life of the imaging member. The charge transport layer 20 can be a substantially non-photoconductive material, but one which supports the injection of photogenerated holes from the charge generation layer 18. The layer 20 is normally transparent in a wavelength region in which the electrophotographic imaging member is to be used when exposure is effected therethrough to ensure that most of the incident radiation is utilized by the underlying charge generating layer 18. The charge transport layer should exhibit excellent optical transparency with negligible light absorption and no charge generation when exposed to a wavelength of light useful in xerography, e.g., 400 to 900 nanometers. In the case when the photoreceptor is prepared with the use of a transparent substrate 10 and also a transparent or partially transparent conductive layer 12, image wise exposure or erase may be accomplished through the substrate 10 with all light passing through the back side of the substrate. In this case, the materials of the layer 20 need not transmit light in the wavelength region of use if the charge generating layer 18 is sandwiched between the substrate and the charge transport layer 20. The charge transport layer 20 in conjunction with the charge generating layer 18 is an insulator to the extent that an electrostatic charge placed on the charge transport layer is not conducted in the absence of illumination. The charge transport layer 20 should trap minimal charges as the charge passes through it during the discharging process.

The charge transport layer 20 may include any suitable charge transport component or activating compound useful as an additive molecularly dispersed in an electrically inactive polymeric material to form a solid solution and thereby making this material electrically active. The charge transport component may be added to a film forming polymeric material, which is otherwise incapable of supporting the injection of photogenerated holes from the charge generation material and incapable of allowing the transport of these holes through. This addition converts the electrically inactive polymeric material to a material capable of supporting the injection of photogenerated holes from the charge generation layer 18 and capable of allowing the transport of these holes through the charge transport layer 20 in order to discharge the surface charge on the charge transport layer. The charge transport component typically comprises small molecules of an organic compound which cooperate to transport charge between molecules and ultimately to the surface of the charge transport layer.

The charge transporting small molecule may be dissolved or molecularly dispersed in a film forming electrically inert polymer such as a polycarbonate. The term "dissolved" as employed herein is defined herein as forming a solution in which the small molecule is dissolved in the polymer to form a homogeneous phase. The expression "molecularly dispersed" is used herein is defined as a charge transporting small molecule dispersed in the polymer, the small molecules being dispersed in the polymer on a molecular scale. Any suitable charge transporting or electrically active small molecule may be employed in the charge transport layer of this invention. The expression charge transporting "small molecule" is defined herein as a monomer that allows the free charge photogenerated in the transport layer to be transported across the transport layer. Typical charge transporting small molecules include, for example, pyrazolines such as 1-phenyl-3-(4'-diethylamino styryl)-5-(4"-diethylamino phenyl) pyrazoline, diamines such as N,N'-diphenyl-N,N'-bis(3-methylphenyl)-(1,1'-biphenyl)-4,4'-diamine, hydrazones such as N-phenyl-N-methyl-3-(9-ethyl)carbazyl hydrazone and 4-diethyl amino benzaldehyde-1,2-diphenyl hydrazone, and oxadiazoles such as 2,5-bis(4-N,N'-diethylaminophenyl)-1,2,4-oxadiazole, stilbenes and the like. However, to avoid cycle-up in machines with high throughput, the charge transport layer should be substantially free (less than about two percent) of di or triamino-triphenyl methane. As indicated above, suitable electrically active small molecule charge transporting compounds are dissolved or molecularly dispersed in electrically inactive polymeric film forming materials. A small molecule charge transporting compound that permits injection of holes from the pigment into the charge generating layer with high efficiency and transports them across the charge transport layer with very short transit times is N,N'-diphenyl-N,N'-bis(3-methylphenyl)-(1,1'-biphenyl)-4,4'-diamine (TPD).

If desired, the charge transport material in the charge transport layer may comprise a polymeric charge transport material or a combination of a small molecule charge transport material and a polymeric charge transport material.

Any suitable electrically inactive resin binder insoluble in the alcohol solvent may be employed in the charge transport layer of this invention. Typical inactive resin binders include polycarbonate resin (such as MAKROLON), polyester, polyarylate, polyacrylate, polyether, polysulfone, and the like.

Molecular weights can vary, for example, from about 20,000 to about 150,000. Examples of binders include polycarbonates such as poly(4,4'-isopropylidene-diphenylene)carbonate (also referred to as bisphenol-A-polycarbonate, poly(4,4'-cyclohexylidinediphenylene)carbonate (referred to as bisphenol-Z polycarbonate), poly(4,4'-isopropylidene-3,3'-dimethyl-diphenyl)carbonate (also referred to as bisphenol-C-polycarbonate) and the like. Any suitable charge transporting polymer may also be used in the charge transporting layer of this invention. The charge transporting polymer should be insoluble in the alcohol solvent employed to apply the optional overcoat layer. These electrically active charge transporting polymeric materials should be capable of supporting the injection of photogenerated holes from the charge generation material and be capable of allowing the transport of these holes there through.

Any suitable and conventional technique may be used to mix and thereafter apply the charge transport layer coating mixture to the charge generating layer. Typical application techniques include spraying, dip coating, roll coating, wire wound rod coating, and the like. Drying of the deposited coating may be effected by any suitable conventional technique such as oven drying, infrared radiation drying, air drying and the like.

Generally, the thickness of the charge transport layer is between about 10 and about 50 micrometers, but thicknesses outside this range can also be used. The hole transport layer should be an insulator to the extent that the electrostatic charge placed on the hole transport layer is not conducted in the absence of illumination at a rate sufficient to prevent formation and retention of an electrostatic latent image thereon. In general, the ratio of the thickness of the hole transport layer to the charge generator layers can be maintained from about 2:1 to 200:1 and in some instances as great as 400:1. The charge transport layer, is substantially non-absorbing to visible light or radiation in the region of intended use but is electrically "active" in that it allows the injection of photogenerated holes from the photoconductive layer, i.e., charge generation layer, and allows these holes to be transported through itself to selectively discharge a surface charge on the surface of the active layer.

In the present embodiments, the charge transport layer is comprised of a thermalsetting resin and a polyhedral oligomeric silsesquioxane, which extends the life of the layer because the wear and abrasion resistance is increased. The combination of a thermalsetting resin and polyhedral oligomeric silsesquioxane is achieved by incorporating a small amount, such as for example from about 0.1 percent to about 40 percent by weight of total weight of the layer, of a compatible aminoplast resin and a polyhedral oligomeric silsesquioxane into a standard charge transport layer. The aminoplast resin can be, for example, melamine. These resins impart the mechanical enhancement and wear improvement characteristic to the charge transport layer without deteriorating other functional performances.

The thermalsetting resins are prepared in combination via a co-binder system comprising a water "insoluble" resin of melamine (CYMEL 303, available from Cytec Corp.), glycouril (CYMEL 1170, available from Cytec Corp.), or benzoguamine (CYMEL 659, available from Cytec Corp.) and a polyhedral oligomeric silsesquioxane (POSS). The polyhedral oligomeric silsesquioxane is represented by the general molecular formula below, that is a chemical analogue, or a molecule that is part of the same group but with some variation or variations in the side groups, such as differences in the R substituents as illustrated below:

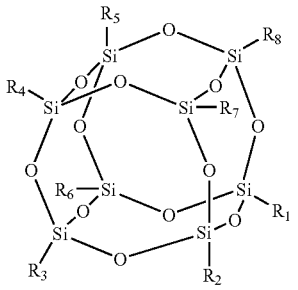

wherein each R is independently selected from the group consisting of at least one of hydrogen and from about 1 to about 40 carbon atoms, and an optional overcoat layer disposed on the charge transport layer. For example, R can be an alkyl, with for example, from about 1 to about 40 carbon atoms; an alkenyl, with for example, from about 2 to about 40 carbon atoms, such vinyl or allyl; an alkoxy with for example, from about 1 to about 40 carbon atoms; an aryl with for example, from about 6 to about 30 carbon atoms, such as phenyl, substituted phenyl, pyridyl or substituted pyridyl; higher aromatics such as naphthalene and antracene; an alkylphenyl with up to about 40 carbon atoms; an alkoxyphenyl with for example, from about 6 to about 40 carbon atoms; an aryl with for example, from about 6 to about 30 carbon atoms; an substituted aryl with for example, from about 6 to about 30 carbons; and a halogen.

This combination of a thermalsetting binder and POSS is compatible with mTBD and polycarbonate, as well as the charge transport molecule and binder, used in the standard charge transport formulation. Charge transport layers incorporating the combination in its formulation demonstrated improved wear and abrasion resistance is increased while the other performance properties remained satisfactory and did not deteriorate.

In specific embodiments, the polyhedral oligomeric silsesquioxane (POSS) is selected from the group consisting of a phenyl POSS, a vinyl POSS, a octaisobutyl POSS, and mixtures thereof.

The structure of phenyl POSS is shown as follows:

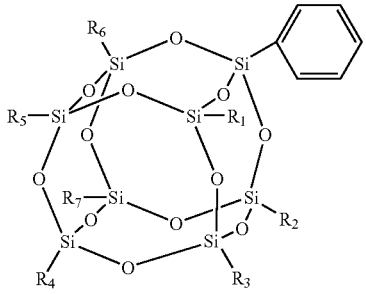

R = i-octyl

The structure of vinyl POSS is shown as follows:

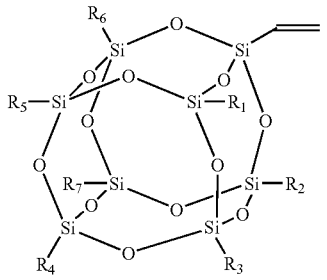

The structure of octaisobutyl POSS is shown as follows:

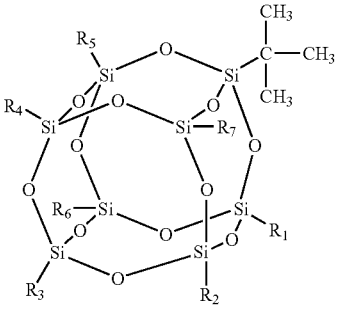

In embodiments where the CTL comprises dual or multiple layers, as illustrated in FIG. 3, the first layer (20L) typically comprises a film forming polymer, such as a polycarbonate, and a charge transport compound. While the resin combination may be incorporated in both layers (20L, 20T), the top layer (20T) generally comprises the resin combination to impart crosslinking properties needed to reduce resistance as the top layer is subjected to the most abrasion and wear.

Other layers such as conventional ground strip layer 45 including, for example, conductive particles dispersed in a film forming binder may be applied to one edge of the imaging member to promote electrical continuity to the conductive layer 12. The ground strip layer 45 may include any suitable film forming polymer binder and electrically conductive particles. Typical ground strip materials include those enumerated in U.S. Pat. No. 4,664,995, the entire disclosure of which is incorporated by reference herein. The ground strip layer 45 may have a thickness from about 7 micrometers to about 42 micrometers, for example, from about 14 micrometers to about 23 micrometers.

An optional overcoat layer is coated on the charge-transporting layer. In embodiments, the overcoat layer is a continuous overcoat layer and has a thickness of from about 0.1 to about 10 micrometers, or from about 1 to about 8 microns, or from about 2 to about 5 microns. Any suitable or conventional technique may be used to mix and thereafter apply the overcoat layer coating mixture on the charge transport layer. Typical application techniques include spraying, dip coating, roll coating, wire wound rod coating, and the like. Drying of the deposited coating may be effected by any suitable conventional technique such as oven drying, infrared radiation drying, air drying, and the like. The dried overcoating should transport holes during imaging and should not have too high a free carrier concentration. Free carrier concentration in the overcoat increases the dark decay. In embodiments, the dark decay of the overcoated layer should be about the same as that of the uncoated, control device.

Various exemplary embodiments encompassed herein include a method of imaging which includes generating an electrostatic latent image on an imaging member, developing a latent image, and transferring the developed electrostatic image to a suitable substrate.

While the description above refers to particular embodiments, it will be understood that many modifications may be made without departing from the spirit thereof. The accompanying claims are intended to cover such modifications as would fall within the true scope and spirit of embodiments herein.

The presently disclosed embodiments are, therefore, to be considered in all respects as illustrative and not restrictive, the scope of embodiments being indicated by the appended claims rather than the foregoing description. All changes that come within the meaning of and range of equivalency of the claims are intended to be embraced therein.

EXAMPLES

The example set forth herein below and is illustrative of different compositions and conditions that can be used in practicing the present embodiments. All proportions are by weight unless otherwise indicated. It will be apparent, however, that the embodiments can be practiced with many types of compositions and can have many different uses in accordance with the disclosure above and as pointed out hereinafter.

Control Example 1

An imaging member was prepared with a charge transport layer having a weight ratio of 40/60 mTBD/PCZ-400, a three-component undercoat layer and a charge generation layer comprising hydroxygallium phthalocyanine Type V (PC7).

Control Example 2

A second control imaging member was prepared the same way as in Control Example 1.

Example 1

An experimental device was prepared with a dual-dopant charge transport layer having a weight ratio of 37/57/2.4/2.4 mTBD/PCZ-400/CYMEL 303/phenyl POSS and a charge generation layer comprising silicon phthalocyanine (PC5).

According the photo induced discharge curves (PIDC), the control device demonstrated high residual and $V_{tail}$, which is atypical as the $V_{tail}$ for such configuration should generally be between 80-110 V. The results demonstrated that the experimental device incorporating the melamine and phenyl POSS additives in the charge transport layer had much lower values. There was no apparent difference in electrical when compared with the control device.

Wear testing of the dual-dopant device showed an average of about 2 times in wear rate improvement over that of the control devices. The results along with key photoelectrical properties are summarized in Table 1. In Hodaka wear test fixture, which is a BCR/cleaning blade/single component system, the wear rate improved by about 2 times from about 105 to about 50 nm/kc for partially cross-linked CTL as compared to the control CTL.

TABLE 1

| Device | Binder (%) | CYMEL 303 | $V_{POSS}$ | $V_{low}$(2.8) | $V_{erase}$ | ΔVer@5k | BCR Wear Rate (kcycles/nm) |
|---|---|---|---|---|---|---|---|
| 1 | 5 | 50 | 50 | 283 | 73 | 6 | 52 |
| Control 1 | 0 | N/A | N/A | 295 | 131 | 45 | 105 |
| Control 2 | 0 | N/A | N/A | 281 | 75 | 1 | 101 |

Figure 4:
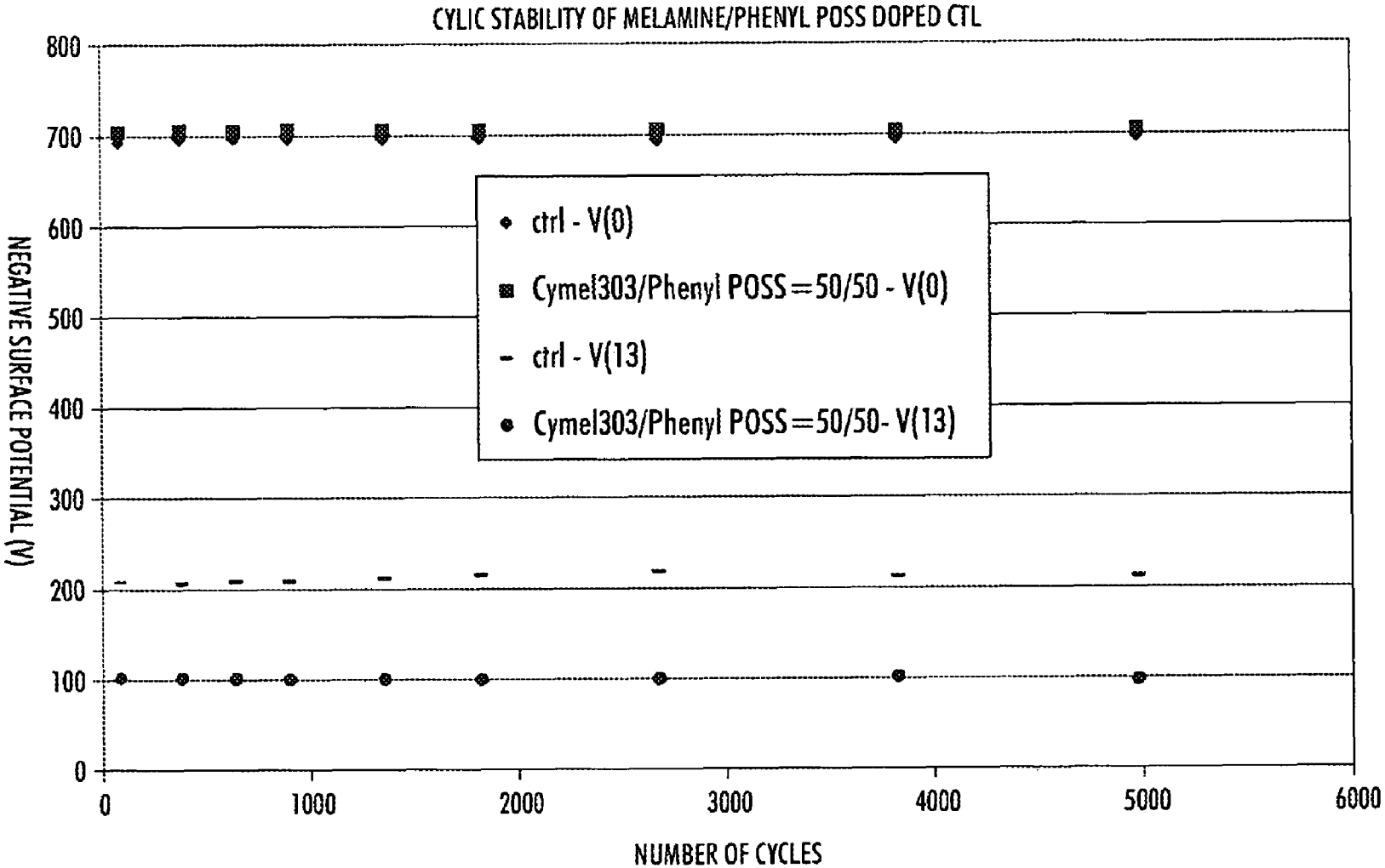
FIG. 4. is a graph illustrating cyclic stability of the experimental device having a charge transport layer doped with phenyl POSS according to the present embodiments.
Figure 5:
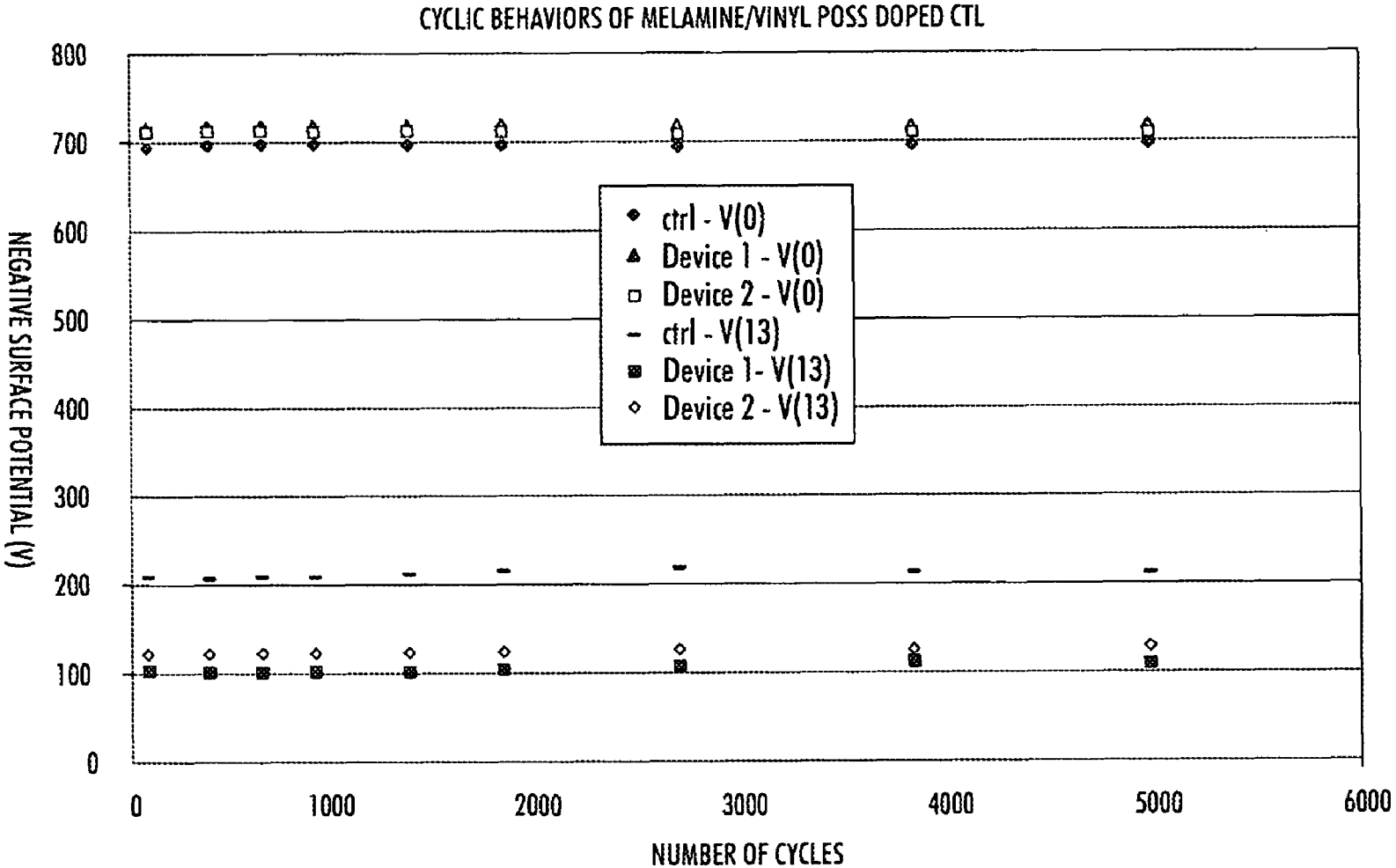
FIG. 5 is a graph illustrating cyclic stability of the experimental device having a charge transport layer doped with vinyl POSS according to another embodiment.

Cyclic stability was tested on an electrical scanner and after 5000 cycles only about a 5 V increase for the $V_{low}$(2.8) and residual voltage, as shown in FIG. 4 and FIG. 5.

Example 2

An experimental device was prepared with a dual-dopant charge transport layer having a weight ratio of 37/57/2.4/2.4 or 39/59/1.6/0.4 mTBD/PCZ-400/CYMEL 303/vinyl POSS and a charge generation layer comprising silicon phthalocyanine (PC5).

According the photo induced discharge curves (PIDC), the control device demonstrated high residual and $V_{tail}$, which is atypical as the $V_{tail}$ for such configuration should generally be between 80-110 V. The results demonstrated that the experimental device incorporating the melamine and phenyl POSS additives in the charge transport layer had much lower values. There was no apparent difference in electrical when compared with the control device.

Wear testing of the dual-dopant device containing about 2 to about 5 percent loading of the thermalsetting binders showed an average of about 2 to 3 times in wear rate improvement over that of the control devices. The results along with key photoelectrical properties are summarized in Table 2. In Hodaka wear test fixture, which is a BCR/cleaning blade/single component system, the wear rate improved by about 2 times from about 105 to about 30-50 nm/kc for partially cross-linked CTL as compared to the control CTL. Most notably, for the device having a weight ratio of 20/18 vinylPOSS/melamine, the wear rate was a remarkably low at 30.2 nm/kc, the lowest wear ever observed for non-overcoated devices.

TABLE 2

| Device | Binder (%) | CYMEL 303 | $V_{POSS}$ | $V_{low}$(2.8) | $V_{erase}$ | ΔVer@5k | BCR Wear Rate (kcycles/nm) |
|---|---|---|---|---|---|---|---|
| 1 | 5 | 50 | 50 | 293 | 77 | 13 | 57 |
| 2 | 2 | 80 | 20 | 286 | 94 | 13 | 30 |
| Control 1 | 0 | N/A | N/A | 295 | 131 | 45 | 105 |
| Control 2 | 0 | N/A | N/A | 281 | 75 | 1 | 101 |

Device 1 contains 5% in weight of 50/50 Cymel303/Vinyl POS and Device 2 has 2% in weight of 80/20 Cymel303/Vinyl POSS.

Experimental devices 1 and 2 were tested for cyclic stability on an electrical scanner and after 5000 cycles only about a 5 V increase for the $V_{low}$(2.8) and residual voltage.

Example 3

An experimental device was prepared with a dual-dopant charge transport layer having a weight ratio of 39/57/2.4/2.4 mTBD/PCZ-400/CYMEL 303/octaisobutyl POSS and a charge generation layer comprising silicon phthalocyanine (PC5). A reference device 2 was prepared with a dual-dopant charge transport layer having a weight ratio of 39/57/6 mTBD/PCZ-400/octaisobutyl POSS=39/57/5 (e.g., only octaisobutyl POSS doped) was also prepared and good time zero photoelectrical and cyclic properties were observed.

According the photo induced discharge curves (PIDC), the control device demonstrated high residual and $V_{tail}$, which is atypical as the $V_{tail}$ for such configuration should generally be between 80-110 V. The results demonstrated that the experimental device incorporating the melamine and octaisobutyl POSS additives in the charge transport layer had much lower values. There was no apparent difference in electrical when compared with the control device.

Wear testing of the of the dual-dopant device containing about 2 to about 5 percent loading of the thermalsetting binders showed an average of about 2 to 3 times in wear rate improvement over that of the control devices. The results along with key photoelectrical properties are summarized in Table 3. In Hodaka wear test fixture, which is a BCR/cleaning blade/single component system, the wear rate improved by about 2 times from about 105 to about 60 nm/kc for partially cross-linked CTL as compared to the control CTL. The reference device 2, which contained only octaisobutyl POSS, had wear rate of about 80 nm/kc.

TABLE 3

| Device | Binder (%) | CYMEL 303 | $V_{POSS}$ | $V_{low}$(2.8) | $V_{erase}$ | ΔVer@5k | BCR Wear Rate (kcycles/nm) |
|---|---|---|---|---|---|---|---|
| 1 | 5 | 50 | 50 | 284 | 119 | 3 | 60 |
| 2 | 5 | 0 | 100 | 280 | 90 | 0 | 82 |
| Control 1 | 0 | N/A | N/A | 295 | 131 | 45 | 105 |
| Control 2 | 0 | N/A | N/A | 281 | 75 | 1 | 101 |

Device 1 contains 5% in weight of 50/50 Cymel303/Octaisobutyl POSS.

The experimental device 1 was also tested for cyclic stability on electrical scanner and after 5000 cycles only about a 3 V increase for the $V_{low}$(2.8) and residual voltage.

Control Example 3

A third control imaging member was prepared the same way as in Control Example 1, except that it had a charge generation layer comprised of chlorogallium phtahlocyanine.

Control Example 4

A fourth control imaging member was prepared the same way as in Control Example 1, except that it had a charge generation layer comprised of chlorogallium phtahlocyanine.

Example 4

A standard PTFE device was prepared having a CTL of mTBD/PCZ400/PTFE=38.5/54/7, and a CGL comprised of chlorogallium phtahlocyanine. Experimental devices were prepared by doping from about 2% to about 8% in total solid weight of CYMEL 303 and vinyl POSS in regular PTFE CTL dispersions, and also had a charge generation layer comprised of chlorogallium phtahlocyanine.

The PTFE, vinyl POSS, and melamine system gave very promising results and its time zero electrical properties are very similar to that of control and standard devices. Table 4 provides a summary of photoelectrical and BCR wear test results. The results demonstrated that the melamine and vinyl POSS additives are indeed very benign and very compatible with the PTFE CTL.

The system was further tested for wear resistance. Wear testing of the experimental devices comprised of the melamine, vinyl POSS, and PTFE were performed on Hodak wear test fixtures. The experimental devices demonstrated an average of more than 2 times improvement in wear rate over that of the control and standard devices. In particular, for one device comprising 2% weight of the melamine and vinyl POSS, where the ratio between the two dopants is 90/10, the BCR wear rate was only 23 nm/kc, significantly better than typical PTFE and standard CTLs. The presence of PTFE particles also improve squeakiness of the wear test fixture.

The experimental devices were further tested for cyclic stability on electrical scanner and after 5000 cycles only about a 20-50 V increase for the $V_{low}$(2.8) and residual voltage.

TABLE 4

| Device | Total non-PTFE Dopants (%) | CYMEL 303 | $V_{POSS}$ | $V_{low}$(2.8) | $V_{erase}$ | ΔVer@5k | BCR Wear Rate (kcycles/nm) |
|---|---|---|---|---|---|---|---|
| PTFE/Melamine/Vinyl POSS | 2 | 90 | 10 | 270 | 20 | 50 | 23 |
| PTFE/Melamine/Vinyl POSS | 8 | 10 | 90 | 283 | 45 | 22 | 54 |
| Melamine/Vinyl POSS | 8 | 37 | 63 | 281 | 44 | 26 | 57 |
| Standard PTFE CTL | N/A | N/A | N/A | 267 | 37 | 60 | 72 |
| Control 3 | N/A | N/A | N/A | 287 | 64 | 45 | 88 |
| Control 4 | N/A | N/A | N/A | 281 | 75 | 18 | 94 |

All the patents and applications referred to herein are hereby specifically, and totally incorporated herein by reference in their entirety in the instant specification.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. An imaging member comprising:

a substrate;

an undercoat layer disposed on the substrate;

a charge generation layer disposed on the undercoat layer;

a dual-dopant charge transport layer disposed on the charge generation layer, the dual-dopant charge transport layer further comprising a polymeric binder and a combination of a melamine resin and a polyhedral oligomeric silsesquioxane; and an optional overcoat layer disposed on the charge transport layer.

2. The imaging member of claim 1, wherein the melamine resin is selected from the group consisting of melamine, glycouril, benzoguamine, and mixtures thereof.

3. The imaging member of claim 1, wherein the polyhedral oligomeric silsesquioxane is represented by the general molecular formula:

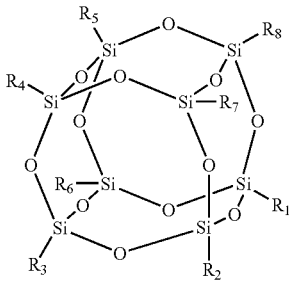

wherein each R is independently selected from the group consisting of at least one of hydrogen and from about 1 to about 40 carbon atoms.

4. The imaging member of claim 3, wherein the polyhedral oligomeric silsesquioxane is selected from the group consisting of a vinyl polyhedral oligomeric silsesquioxane, a phenyl polyhedral oligomeric silsesquioxane, an octaisobutyl polyhedral oligomeric silsesquioxane, and mixtures thereof.

5. The imaging member of claim 1, wherein the charge transport layer is doped with polytetrafluoroethylene particles in an amount of from about 2 percent to about 8 percent by weight of the total weight of the charge transport layer.

6. The imaging member of claim 1, wherein the substrate comprises a material selected from the group consisting of a metal, metal alloy, aluminum, zirconium, niobium, tantalum, vanadium, hafnium, titanium, nickel, stainless steel, chromium, tungsten, molybdenum, and mixtures thereof.

7. The imaging member of claim 1, wherein a thickness of the charge transport layer is from about 10 μm to about 50 μm.

8. The imaging member of claim 1, wherein the charge transport layer comprises from about 0.1 percent to about 40 percent of the melamine resin by weight of the total weight of the charge transport layer.

9. The imaging member of claim 1, wherein the charge transport layer comprises from about 0.1 percent to about 40 percent of the polyhedral oligomeric silsesquioxane by weight of the total weight of the charge transport layer.

10. The imaging member of claim 1, wherein the polymeric binder is a polycarbonate Z polymer.

11. The imaging member of claim 10, further comprises polytetrafluoroethylene particles uniformly dispersed throughout the polymeric binder.

12. The imaging member of claim 1, wherein the undercoat layer comprises a compound selected from the group consisting of phenolic resin, phenolic compound, metal oxide, silicon oxide, polyamides, hydroxy alkyl methacrylates, nylons, gelatin, hydroxyl alkyl cellulose, organopolyphosphazines, organosilanes, organotitanates, organozirconates, nitrogen-containing siloxanes, and mixtures thereof.

13. The imaging member of claim 1, wherein the charge generation layer comprises a material selected from the group consisting of inorganic photoconductive materials, amorphous selenium, trigonal selenium, selenium alloys, selenium-tellurium, selenium-tellurium-arsenic, selenium arsenide, organic photoconductive materials, phthalocyanine pigments, X-form of metal free phthalocyanine, metal phthalocyanines, vanadyl phthalocyanine, copper phthalocyanine, quinacridones, dibromo anthanthrone pigments, benzimidazole perylene, substituted 2,4-diamino-triazines, polynuclear aromatic quinones, enzimidazole perylene, and mixtures thereof.

14. The imaging member of claim 1, wherein the charge transport layer has a bottom layer and a top layer.

15. The imaging member of claim 14, wherein the top layer has a higher weight ratio of the combination of the melamine resin and the polyol than the bottom layer by total weight of the charge transport layer.

16. The imaging member of claim 14 having a wear rate of from about 60 to about 80 kcycles/nm.

17. An imaging member comprising:

a substrate;

an undercoat layer disposed on the substrate;

a charge generation layer disposed on the undercoat layer;

a dual-dopant charge transport layer disposed on the charge generation layer, the dual-dopant charge transport layer further comprising a polycarbonate Z polymer and a combination of a melamine resin and a polyhedral oligomeric silsesquioxane, wherein the polyhedral oligomeric silsesquioxane is represented by the general molecular formula:

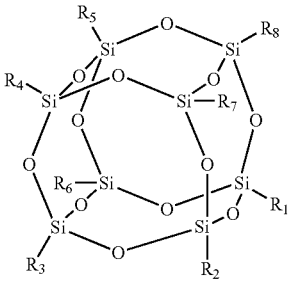

wherein each R is independently selected from the group consisting of at least one of hydrogen and from about 1 to about 40 carbon atoms; and an optional overcoat layer disposed on the charge transport layer.

18. An image forming apparatus for forming images on a recording medium comprising:

a) an imaging member having a charge retentive-surface to receive an electrostatic latent image thereon, wherein the imaging member comprises a substrate, an undercoat layer disposed on the substrate, a charge generation layer disposed on the undercoat layer, a dual-dopant charge transport layer disposed on the charge generation layer, the dual-dopant charge transport layer further comprising a polymeric binder and a combination of a melamine resin and a polyhedral oligomeric silsesquioxane, wherein the polyhedral oligomeric silsesquioxane is represented by the general molecular formula:

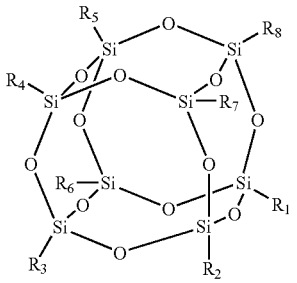

wherein each R is independently selected from the group consisting of at least one of hydrogen and from about 1 to about 40 carbon atoms, and an optional overcoat layer disposed on the charge transport layer;

b) a development member for applying a developer material to the charge-retentive surface to develop the electrostatic latent image to form a developed image on the charge-retentive surface;

c) a transfer member for transferring the developed image from the charge-retentive surface to an intermediate transfer member or a copy substrate; and d) a fusing member for fusing the developed image to the copy substrate.

19. The image forming apparatus of claim 18, wherein the melamine resin is selected from the group consisting of melamine, glycouril, benzoguamine, and mixtures thereof.

20. The image forming apparatus of claim 18, wherein the polyhedral oligomeric silsesquioxane is selected from the group consisting of a vinyl polyhedral oligomeric silsesquioxane, a phenyl polyhedral oligomeric silsesquioxane, an octaisobutyl polyhedral oligomeric silsesquioxane, and mixtures thereof.

21. The image forming apparatus of claim 18, wherein a thickness of the charge transport layer is from about 10 μm to about 50 μm.

22. The image forming apparatus of claim 18, wherein the charge transport layer comprises from about 0.1 percent to about 40 percent of the melamine resin by weight of the total weight of the charge transport layer.

23. The image forming apparatus of claim 18, wherein the charge transport layer comprises from about 0.1 percent to about 40 percent of the polyhedral oligomeric silsesquioxane by weight of the total weight of the charge transport layer.

24. The image forming apparatus of claim 18, wherein the polymeric binder is a polycarbonate Z polymer.

* * * * *